US005150257A

United States Patent [19]

Mohabbatizadeh et al.

[11] Patent Number: 5,150,257

[45] Date of Patent: Sep. 22, 1992

[54] HIGH RELIABILITY, LOW INTENSITY BACK LIT SR AND NVGC INDICATOR ASSEMBLY

[75] Inventors: Akbar Mohabbatizadeh, Huntington Beach; Barry J. Weidenhammer, Newport Beach, both of Calif.

[73] Assignee: Eaton Corporation, Cleveland, Ohio

[21] Appl. No.: 736,862

[22] Filed: Jul. 29, 1991

[51] Int. Cl.[5] ..... F21V 13/00

[52] U.S. Cl. ..... 359/601; 359/609; 359/39; 359/245; 340/815.32; 362/29

[58] Field of Search ..... 359/39, 53, 245, 263, 359/276, 277, 601, 609, 613, 614, 886, 894; 340/815.32; 341/23; 362/29, 293; 200/308, 310, 313, 314

[56] References Cited

U.S. PATENT DOCUMENTS

| | | | |
|---|---|---|---|
| 3,708,219 | 1/1973 | Forlini et al. | 350/150 |
| 3,743,382 | 7/1973 | Rosenberg | 350/160 |
| 4,180,847 | 12/1979 | Cresko et al. | 362/29 X |
| 4,359,618 | 11/1982 | Stevens | 200/314 |
| 4,535,396 | 8/1985 | Guthrie | 362/29 X |
| 4,722,028 | 1/1988 | Brannon et al. | 362/29 |
| 4,829,407 | 5/1989 | Bushell et al. | 362/29 |
| 4,947,011 | 8/1990 | Muranoi et al. | 200/313 X |
| 4,958,917 | 9/1990 | Hashimoto et al. | 350/357 |
| 4,997,263 | 5/1991 | Cohen et al. | 350/345 |

FOREIGN PATENT DOCUMENTS

| | | | |
|---|---|---|---|
| 2917977 | 11/1979 | Fed. Rep. of Germany | 200/308 |

OTHER PUBLICATIONS

"The Performance of Dichroic Displays for Automotive Instrument Panel Use", SAE Technical Paper Series, Feb. 25-29, 1980.

Aug. 26, 1991 Design News, "Solid-state shutter improves switch display readibility" pp. 42-43.

*Primary Examiner*—Robert J. Pascal

*Attorney, Agent, or Firm*—L. G. Vande Zande

[57] ABSTRACT

An electronic light valve is disposed over a color fill lens formed in an opaque indicia plate and an infrared filter to be energized to a transmissive condition simultaneously with a low intensity light source to illuminate the legend either by ambient light reflecting from the lens or by the light source emitting prescribed energy wavelengths through the lens, whichever thereof having the greater intensity relative to the other. In a deenergized condition of the light source and light valve, the latter blocks ambient light from the legend to prevent viewing thereof.

30 Claims, 3 Drawing Sheets

34
36
32
32a 2
26a
26
6b
6
6a
30
26b
28
4b
4e
24
22
4c
4
20
4d
4a
18a
18c
18
18b
18a

HIGH RELIABILITY, LOW INTENSITY BACK LIT SR AND NVGC INDICATOR ASSEMBLY

BACKGROUND OF THE INVENTION

This invention relates to indicator assemblies of the type which may be used as an indicator panel or in conjunction with an electric pushbutton switch wherein the indicator assembly may constitute a part of the pushbutton operator for the switch. More particularly, this invention relates to indicator assemblies of the aforementioned type which are sunlight readable (SR). Still more particularly, this invention relates to indicator assemblies of the aforementioned type which are sunlight readable (SR) and are back lit illuminated night vision goggle compatible (NVGC).

Indicator assemblies which are both sunlight readable (SR) and night vision goggle compatible (NVGC) have peculiar diverse operating requirements. Such indicator assemblies are commonly utilized in aircraft cockpits wherein strong ambient light on the order of 10,000 foot-candles can exist from bright sunlight. Thus, indicator assemblies intended for such applications must be capable of illumination at an intensity sufficient to clearly denote a contrast with the ambient light conditions. On the other hand, such indicator assemblies used in the same aircraft cockpit application may also be required to be NVG compatible.

In existing SR/NVGC devices, most of the visible and infrared wavelengths of the illumination source are filtered out, leaving only a small portion of the available light spectrum for illumination. As a result, in order to illuminate a legend at a desired intensity that will counteract or overcome very strong ambient light conditions, a strong (high intensity) light source must be utilized. Another concern is that panel area, often referred to as a "footprint", is limited and the space available for such high intensity lamp is quite small. Presently, however, no high intensity light source that has long life and a small footprint exists. High intensity light sources also generate a significant amount of heat, particularly within a confined area such as in an indicator panel assembly or in a pushbutton switch assembly. Heat generated by high intensity light sources can create a high touch temperature at the surface of the switch pushbutton. Such heat also significantly shortens the operating life of the illumination source.

Existing SR/NVGC indicators mainly rely on a variety of optical filters for contrast enhancement and color corrections. The use of filters of these types under intense ambient light and during an "OFF" state of the indicator introduces a phenomenon in which interfaces between the filtering layers create a so-called secondary image, or retroreflectivity, also called "flashback". Reduction of this phenomenon is mainly accomplished by giving particular attention to matching the index of refraction between the layers of filters by means of bonding (free of air bubbles) or laminating layers.

This invention overcomes the need for a high intensity light source in a sunlight readable indicator by covering the legend with an electronic light valve (shutter) which is closed when not indicating and open when indicting. The legend is translucent to permit light from a low intensity light source to pass therethrough, and is reflective of ambient light when the light valve is open, which coincides with energization of the light source. Thus the legend becomes illuminated by the stronger source of light, either the ambient light or the low intensity light source. Such light sources have a high mean time between failure (MTBF) rating and therefor increase the operating lifetime and reliability of the indicator assembly, as well as lower the power consumption and touch temperature at the surface.

SUMMARY OF THE INVENTION

This invention provides an indicator assembly which is particularly well suited for SR/NVGC applications. An indicator assembly constructed in accordance with this invention comprises an electrically controlled light valve disposed over the face of an indicia bearing translucent lens and infrared filter assembly. A low intensity light source is disposed behind the translucent lens and IR filter assembly and is electrically connected to be energized simultaneously with energization of the light valve, which energization causes the light valve to be substantially transparent, transmissive or "open". The translucent lens is reflective of ambient light and transmissive of light from the light source so that illumination of the legend occurs from the greater energy level of either the ambient light or the light source. The light valve is substantially opaque, non-transmissive or "closed" in the de-energized state, although it is preferable that it be slightly transmissive in such state to permit the energized low-intensity light source to be at least weakly visible under night vision conditions in the event of a light valve failure. However, in daylight conditions of high ambient light, the "closed" shutter receives only a small percentage of the ambient light and reflects an even smaller amount back to the observer, thereby effectively eliminating any "flashback" or retroreflectivity. The reliability of the indicator assembly constructed in accordance with this invention is significantly improved through greater operational life of the light source, due in large part to the use of a low intensity light source, and the resulting minimization of generated heat. The foregoing and other features and advantages provided by this invention will become readily apparent when reading the following description and claims in conjunction with the accompanying drawings.

DETAILED DESCRIPTION OF THE PREFERRED EMBODIMENTS

Figure 1:
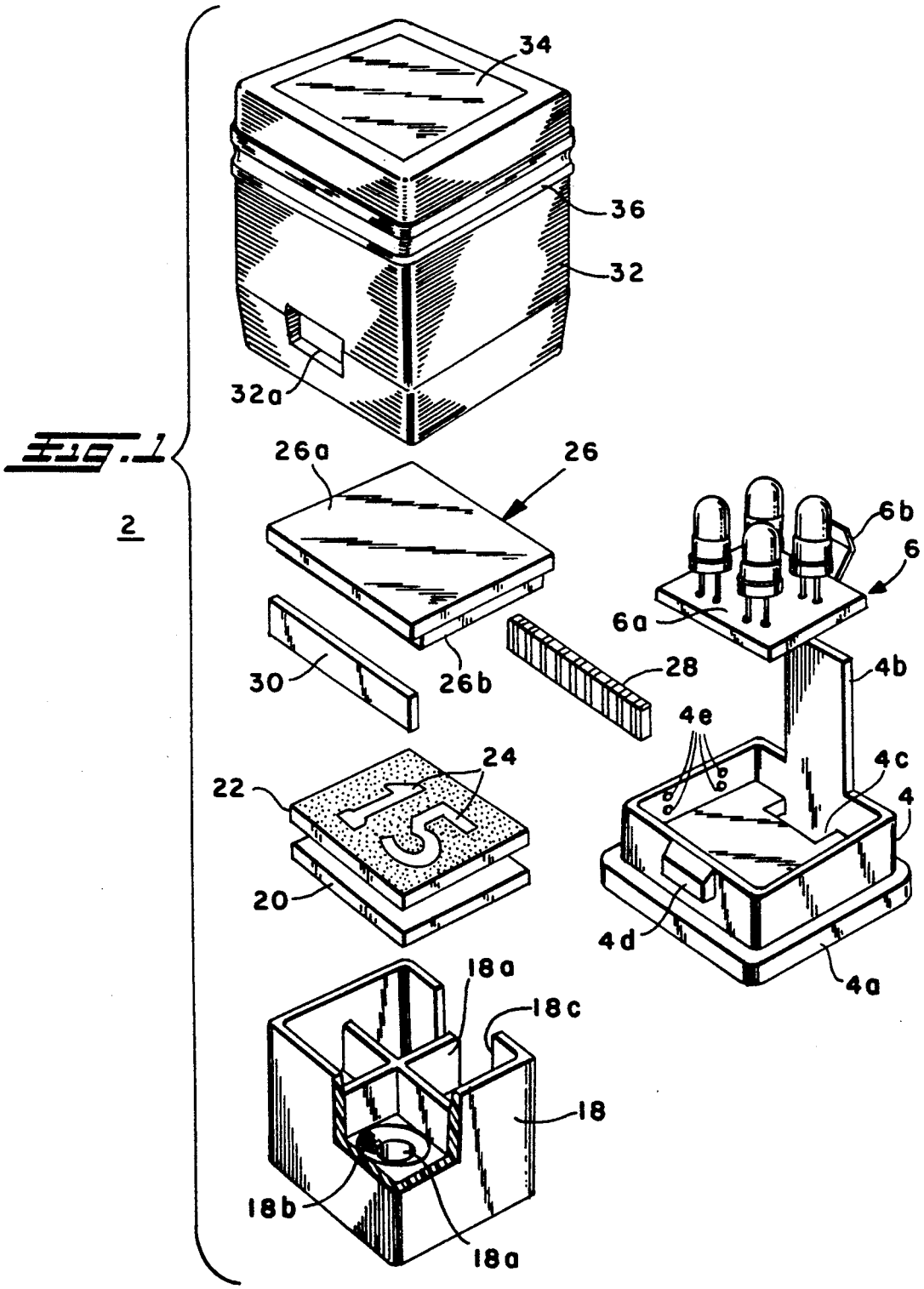
FIG. 1 is an exploded perspective view of a lamp module assembly comprising the indicator assembly constructed in accordance with this invention.

An indicator assembly constructed in accordance with this invention is shown as a part of a lamp module 2 shown in exploded perspective view in FIG. 1 of the drawings. The lamp module can be inserted into a housing such as 38 in FIG. 2 which is in turn mountable to a panel such as an aircraft instrument panel, the housing providing the necessary terminations for connecting the lamp module to the wire conductors of the aircraft electrical system. Alternatively, the housing may contain one or more electric switches operated by the lamp module such as shown in U.S. Pat. No. 4,359,618 issued Nov. 16, 1982 to C. R. Stevens and assigned by mesne assignments to the assignee of this application, the disclosure of which is incorporated herein by reference.

Lamp module 2 comprises a rectangular box-like base 4 to open to the top thereof. Base 4 has a peripheral flange 4*a* adjacent the bottom thereof. A tongue 4*b* extends upward from one sidewall of base 4. An opening 4*c* in the floor of base 4 is aligned with tongue 4*b*. A pair of tabs 4*d* are formed integrally with opposed sidewalls of the base 4 on the exterior thereof. A lamp board assembly 6 is positioned within the open upper end of base 4 by snap-in means such as pairs of detent bosses 4*e* or other suitable means which engage the edge of the insulating board 6*a*. Lamp board assembly 6 mounts a plurality of low intensity light source elements 8 in a prescribed arrangement. Although not specifically shown, board 6*a* preferably has a printed circuit on one side to which the leads of elements 8 are soldered. One or more resilient spring contacts 6*b* are attached to board 6*a* and electrically connected to respective elements 8 through the printed circuit traces. Board assembly 6 is arranged to have spring contact(s) 6*b* disposed over opening 4*c*. The lamp board assembly 6 is preferably bonded within base 4 by a potting compound 10 (FIG. 2) filling the space on either side of board 6*a* and being substantially level with the upper edge of base 4. Potting compound 10 is, however, prevented from filling the opening 4*c* and the areas immediately above and below such opening.

Figure 2:
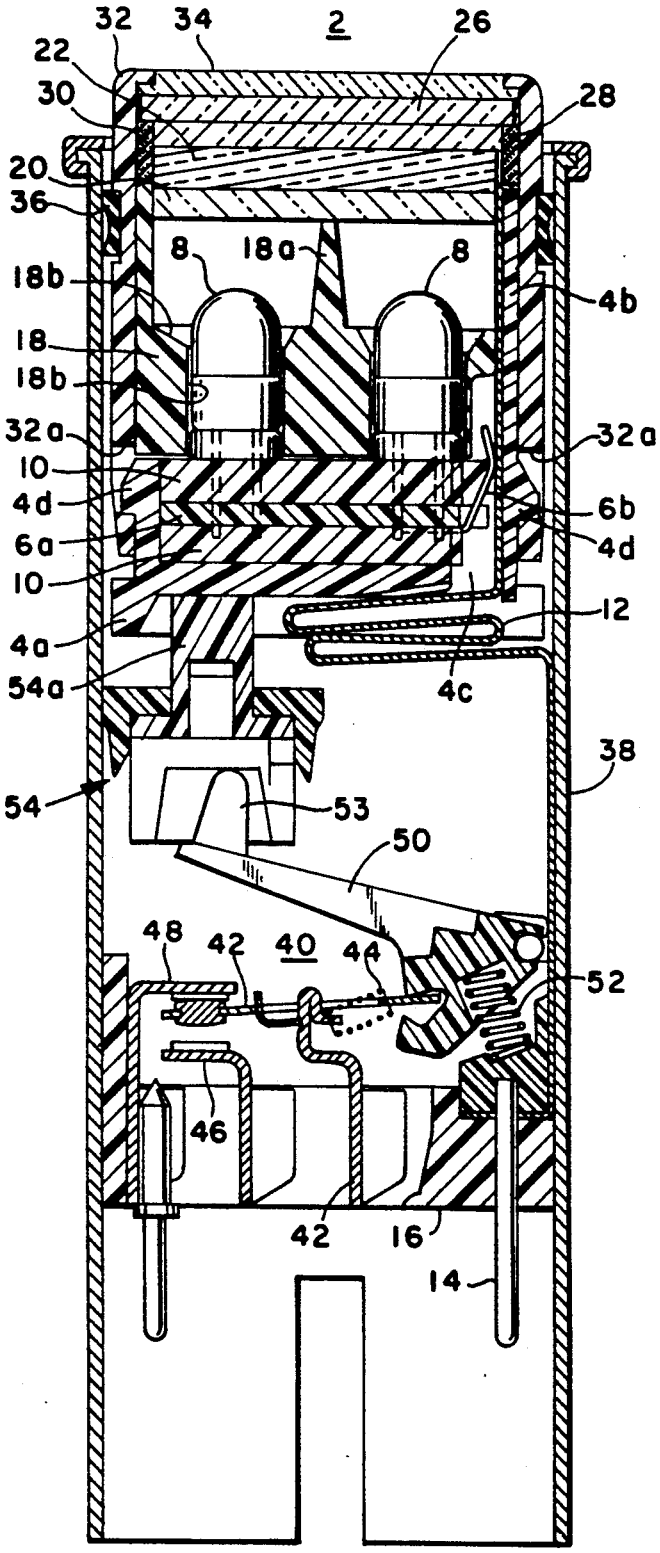
FIG. 2 is a longitudinal cross sectional view of switch incorporating the lamp module of FIG. 1 as the operator for the switch.

As mentioned above, light source elements 8 are low intensity light sources. The elements are preferably light emitting diodes (LEDs) having a narrow emission bandwidth, and an output that is in the millicandlepower range. Alternatively, the light source elements 8 may be incandescent lamps having an MSCP rating (mean spherical candle-power rating) below 0.05 candle-power. As seen in FIG. 2, a flexible printed circuit connector 12 is threaded through opening 4*c* along the inside surface of tongue 4*b* and is folded over the distal end of tongue 4*b*. Spring contact(s) 6*b* make electrical connection with appropriate respective electrical traces on connector 12. The lower end of connector 12 is connected to appropriate pin terminals 14 (only one shown) mounted in a header 16 of the panel indicator unit or pushbutton switch embodying the indicator assembly of this invention as shown in FIG. 2.

A shroud 18 is disposed over light source elements 8 to rest upon the upper surface of base 4 and the potting material 10. As seen in FIGS. 1 and 2, shroud 18 has a cross-shaped barrier wall 18*a* centrally located, establishing four quadrants corresponding to the four light source elements 8. Each quadrant is provided with a hole 18*b* for receiving the respective light source element 8 therein. The base surface of shroud 18 is formed with a countersink bevel surrounding each hole 18*b* to provide a reflector surface for the elements 8. One wall of shroud 18 has an opening 18*c* for receiving tongue 4*b*. It is to be understood that shroud 18 may be partitioned differently, and/or made smaller than shown, to restrict the particular indicator assembly of this invention to less than a full-front area of the indicator unit or pushbutton switch.

A filter plate 20 and an indicia plate 22 are loosely stacked on the upper edges of barrier wall 18*a*. Indicia plate 22 is an opaque acrylic member having indicia (a legend) engraved therethrough and subsequently filled with a translucent plastic material 24 which serves as a lens for the indicator assembly. Fill material 24 is preferably colored to provide a color for the legend of the indicator assembly. The plate 22, being opaque, provides a black background for the colored legend when the indicator assembly is operating in a transmissive or back-lit mode. The plate 22 can also be made non-reflective and fill material 24 made reflective to provide a similar black background for the colored legend when the indicator assembly is operating in a reflective mode. Alternatively, both the indicia plate and the legend may be made translucent, each have a different degree of transmissivity to provide an illuminated background with a contrasting legend. Filter plate 20 is provided to filter out infrared wavelengths to make the indicator assembly NVG compatible.

The indicator assembly further comprises an electronic light valve 26, also referred to as a light shutter or electronic shutter, of the type including a cell containing a fluid suspension of minute particles capable of orientation by an electric or magnetic field to change the transmission of light through the suspension. Light valves of this type have been known for many years and may be of the type disclosed in U.S. Pat. Nos. 3,708,219 and 3,743,382 assigned to Research Frontiers, Inc. of Plainview, N.Y., the disclosures of which are incorporated herein by reference. Such light valves generally comprise two transparent flat substantially parallel plates such as 26*a* and 26*b* in FIG. 3 which are separated a relatively small distance, on the order of 0.5 mil to 50 mils, by an insulator 26*c* disposed around the periphery of the plates to form an enclosed cell. Thin, conductive, transparent coatings 26*d* and 26*e* are applied on the interior surfaces of the respective plates and the cell is filled with the fluid suspension 26*f*. The particles suspended in the fluid are normally randomly dispersed due to Brownian motion and tend to block or extinguish light rays attempting to pass through the suspension and the suspension appears dark or opaque. The particles are needle-shaped, rod-shaped, lath-shaped or in the form of thin flakes and may variously be light absorbing or light reflecting, polarizing, birefringent metallic or non-metallic or dichroic. Application of a voltage to the conductive coating electrodes 26*d* and 26*e* of the light valve (i.e. across the suspension) causes the particles to align perpendicular to the plates 26*a* and 26*b*, wherein light passes through the suspension and the suspension appears transparent. Accordingly, the light valve operates between "open", transmissive, substantially transparent and "closed", non-transmissive, substantially opaque conditions upon the application or removal of an electric signal. There are many forms of light valves of this type, among them being liquid crystal light valves, and this invention is not to be construed as being limited to any one particular light valve embodiment.

Figure 3:
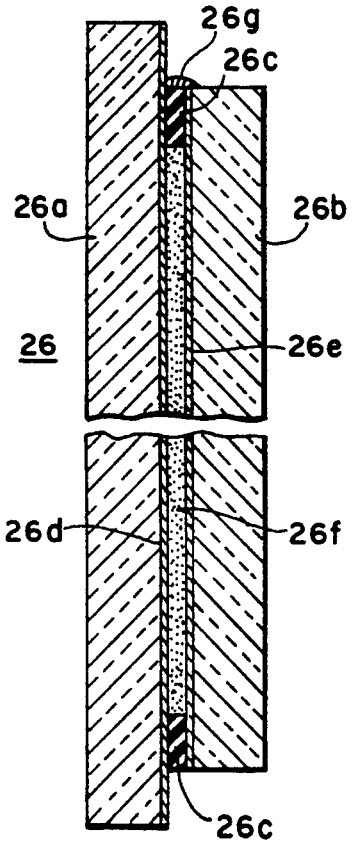
FIG. 3 is a cross sectional view of light valve of the indicator assembly of this invention.
Figure 4:
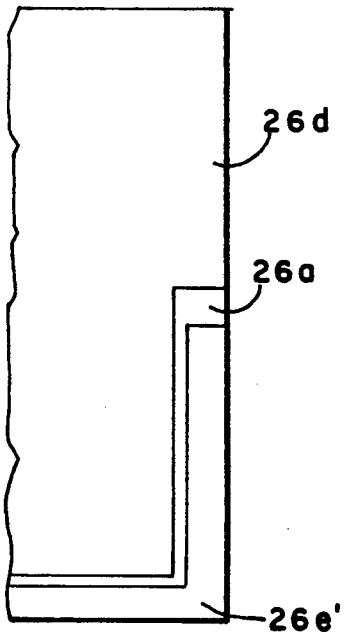
FIG. 4 is a plan view of one member of the light valve shown in FIG. 3.

Light valve 26 of the indicator assembly of this invention has its upper plate 26*a* wider than lower plate 26*b* to facilitate electrical connection to the electrodes 26*d* and 26*e* from one side of the unit. As seen in FIG. 4, the coating 26*d* that forms the electrode for plate 26*a* extends fully to an edge of the plate 26*a* only over approximately one-half the length of the edge. A narrow conductive coating 26*e'* is applied along the remaining one-half length of that edge spaced from the coating 26*d*. Coating 26*e'* may also extend along an adjacent edge as shown in FIG. 4. At some point along the conductive coating 26*e'* a conductive epoxy jumper 26*g* is applied across the insulating spacer 26*c* as shown at the top of FIG. 3 to electrically connect electrode coating 26*e* of plate 26*b* to coating 26*e'* of plate 26*a*. Thus both electrodes are exposed on a common surface of plate 26*a* which extends beyond the corresponding edge of plate 26*b*.

Light valve 26 is loosely placed on indicia plate 22 with plate 26*b* immediately resting on plate 22. Electrical connection of the electrodes 26*d* and 26*e'* with appropriate conductive traces on flexible printed circuit connector 12 is accomplished by an elastomeric connector 28 or the like. A particular elastomeric connector suitable for this application is sold under the Shin-Flex trademark of Shin-Etsu Polymer as a type S connector, available through Shin-Etsu Polymer American, Inc., Union City, Calif. The connector is a resilient strip of alternating segments of insulating and conductor impregnated elastomer materials. Connector 28 is disposed between the flexible printed circuit connector 12 at the top of tongue 4*b* and the overhanging surface of plate 26*a* having electrodes 26*d* and 26*e*, thereon. Electrical connection of the electrodes 26*d* and 26*e*, is made to appropriate traces on printed circuit connector 12 by respective conductive segments of the connector 28 that are in common contact with a respective trace and a respective electrode. A resilient strip 30 of elastomeric material is disposed between the upper surface of shroud 18 and the opposite overhanging surface of plate 26*a* to provide a balanced compressive force to the light valve 26 when the lamp module is fully assembled.

A cap 32 and lens 34 assembly completes the lamp module. Cap 32 envelopes the light valve 26, strips 30 and 28, indicia plate 22, filter plate 20, shroud 18, lamp board assembly 6 and base 4. A pair of openings 32*a* at the lower end of cap 32 engage tabs 4*d* with a snap-fit to secure the members together. The lens 34 is bonded to cap 32 within a rectangular opening in the upper surface of the cap 32 and bears against light valve 26, resiliently compressing elastomeric strips 28 and 30. Light valve 26 in turn holds indicia plate 22 and, filter plate 20 against shroud 18, the latter being directly biased against base 4 by resilient strip 30. Thus, the lens 34, light valve 26, indicia plate 2 and filter 20 are "cold stacked" within the lamp module, i.e., they are not laminated or otherwise bonded together, which significantly reduces cost and potential for manufacturing problems. A rubber seal 36 is disposed in a slot in cap 32 to surround the cap and provide a sliding seal with housing 38.

As seen in FIG. 2, lamp module 2 is inserted into the open upper end of a tubular rectangular housing 38. The housing and lamp module may comprise a panel indicator unit or may further comprise an electric switch such as 40 in which case the lamp module 2 is depressible as a pushbutton operator as shown in FIG. 2. Switch 40 is constructed on header 16 and comprises a common terminal 42 to which an overcenter movable contact 44 is attached. A compression spring 46 is disposed between terminal 42 and movable contact 44 to provide overcenter impetus to the movable contact. Movable contact 42 is reciprocally movable between first stationary contact 46 and second stationary contact 48. A lever actuator 50 is pivotally mounted to header 16 and biased to a raised position by a compression spring 52. The distal end of lever 50 has a boss 53 thereon which bears against the underside of a rotary latch and release, ball point pen type alternate action mechanism 54 mounted within the housing 38. Lamp module 2 in turn rests against the upper part of mechanism 54 and assumes the extended or depressed position of the latch mechanism. One end of movable contact 42 is driven by actuator 50 to cause the switch to snap from one position to another in response to actuator movement. Lamp module 2 is depressible within housing 38 wherein seal 36 slides along an inner surface of housing 38. The underside of base 4 rests on an axially depressible button 54*a* of latch mechanism 54 and depresses the button as the lamp module is depressed. The mechanism 54 is rotationally cammed to a latched-down position on a first depression of lamp module 2, driving actuator 50 downward to operate switch 40 to an alternate position whereat contactor 42 engages contact 46. A subsequent depression of lamp module 2 and latch button 54*a* rotate the latch mechanism to a released, raised position and return of the switch to the contact condition shown in FIG. 2.

Figure 5:
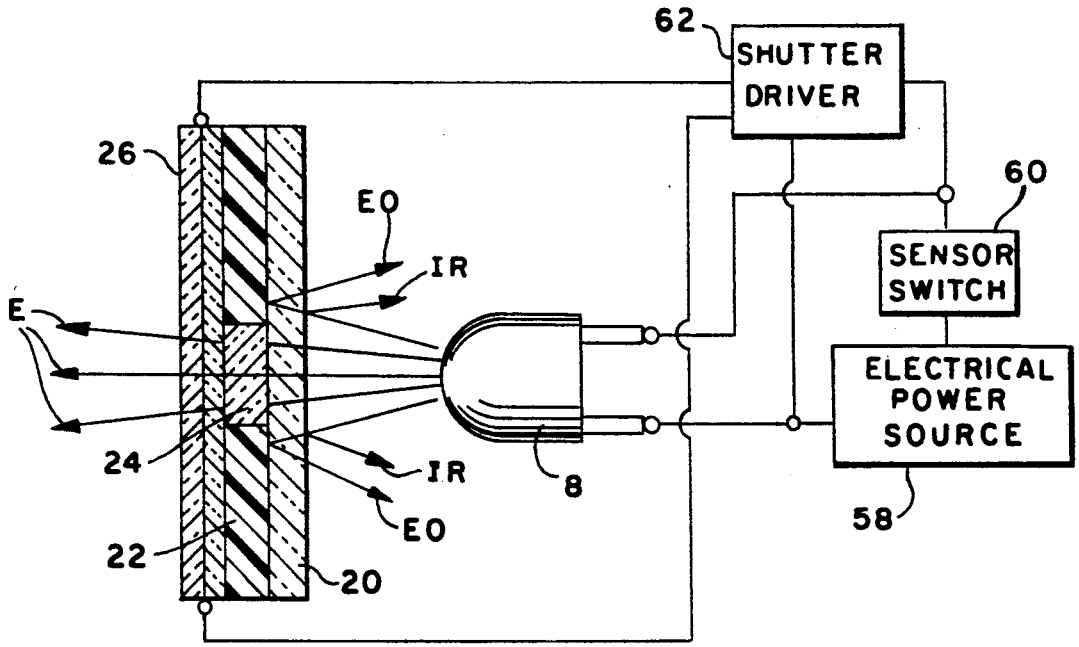
FIG. 5 is a schematic view of the indicator assembly of this invention illustrating a back lighting illuminated operation thereof.
Figure 7:
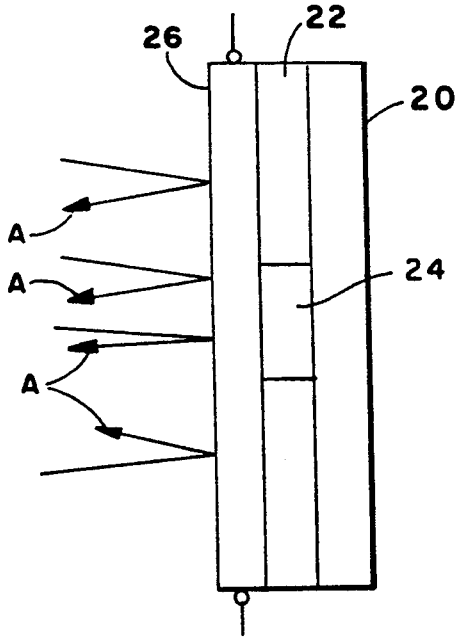
FIG. 7 is a schematic view of the indicator assembly of this invention illustrating an off, non-illuminated condition thereof.

Referring to FIG. 5, it may be seen that the electronic light valve 26 of the indicator assembly is connected to a source of electric power 58 through a condition sensor or switch 60 and a light valve, or shutter, driver 62 which controls the application of power to the indicator assembly. Low intensity light source 8 is connected in parallel with light valve 26 across electric power source 58. It may be observed that application of power from supply 58 will cause light valve 26 and light source 8 to be energized or de-energized simultaneously. As mentioned previously, light valve 26 is transmissive or "open" when energized and is non-transmissive or "closed" when de-energized, although light valves are available wherein the opposite relationship would be true. Accordingly, when light source 8 is de-energized, light valve 26 is "closed" and operates to reflect any ambient light A, thereby covering from view the legend on indicia plate 22 as depicted in FIG. 7. However, in the preferred embodiment light valve 26 is selected to be 25%–35% transmissive even in the de-energized or "closed" condition so that the legend can be viewed in the event of light valve failure if closely scrutinized during low or no ambient light conditions. Under high ambient light conditions the 25%–35% transmissivity results in reflection of 6%–12% of the original intensity which is insufficient to create problems of retroreflectivity.

Upon application of power from source 36 in response to a change in a monitored condition, light source 8 and light valve 26 are energized as shown in FIG. 5. In that figure, no ambient light is present and the legend is illuminated totally by light E emitted from low intensity light source 8 passing through the filter 20, translucent lens material 24, and the transmissive light valve 26. The infrared wavelengths IR of the energy emitted from light source 8 are blocked from transmission through filter 20 and are retained within the lamp module housing. Additionally, light EO impinging upon the opaque plate 22 is reflected within the lamp module shroud 18. The color of the translucent fill material 24, the color of the light emitted by light source 8 and the filter 20 determine the viewed color of the legend. In the condition indicated in FIG. 5, the indicator assembly is operating in an NVGC mode.

Figure 6:
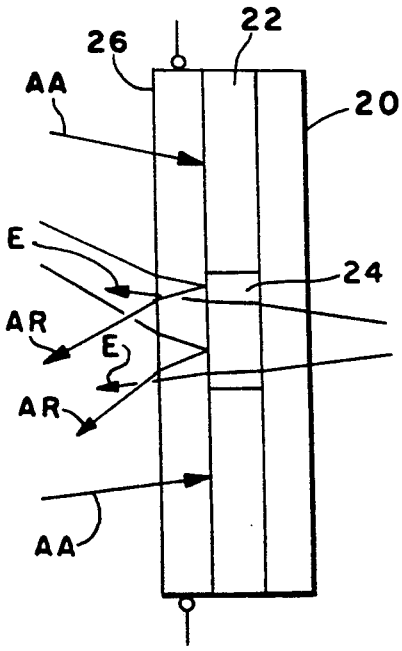
FIG. 6 is a schematic view of the indicator assembly of this invention illustrating an ambient light illuminated operation thereof.

In the event that ambient light is present, such ambient light AR will reflect from the translucent lens fill material 24 when the light valve 26 is energized to its "open" condition as shown in FIG. 6. The ambient light will reflect the color of the translucent fill material 24. Ambient light AA falling on the non-reflective opaque surface of plate 22 will largely be absorbed and provide a black background for the legend. Inasmuch as the light source 8 is energized simultaneously with the energization of electronic light valve 26, it will also be providing light rays E through the translucent fill material. However, in high ambient conditions such as bright sunlight, the ambient light will be many times greater than the low intensity light provided by light source 8.

The provision of a light valve in the indicator assembly of this invention provides several advantages over indicator assemblies of the prior art. When the light valve assumes a "closed" condition, it substantially blocks the legend disposed therebehind from view. By being so blocked, there is no need to be concerned with retroreflectivity or secondary images that may be caused by unmatched incidence of refraction factors among the various layers of the indicator assembly. The removal of this concern permits the cold stacking of the various filters and lenses, eliminating any need for lamination or other bonding which thereby reduces many problems and cost in manufacturing the indicator assembly. Moreover, the covering or uncovering of the legend by the light valve allows the illuminated indication to be accomplished by reflected ambient light under SR conditions, not requiring a high intensity light source to overpower the ambient light intensity. This enables a low intensity light source to be used which provides less burn out of the light source and greater reliability for the indicator assembly, as well as lower touch temperatures for the device. The ability to use low intensity light sources enables LEDs having narrow bands of wavelengths to be utilized which simplifies the filter construction for filtering out of unwanted wavelengths for NVG compatibility and color correction. Although the foregoing has described a preferred embodiment of the invention, it is to be understood that the invention is susceptible of various modifications without departing from the scope of the appended claims.

We claim:

1. An indicator and operator assembly for a pushbutton switch wherein a visual indication of a predetermined legend is provided, comprising a light valve having a substantially opaque first state and a substantially transparent second state, means for energizing and de-energizing said light valve, said light valve having one of said first and second states when said light valve is energized and having the other of said first and second states when said light valve is de-energized, an indicator for providing a visual indication of a predetermined legend contained thereon, said indicator being disposed adjacent to said light valve, said indicator providing said visual indication of said predetermined legend when said light valve is in said second state and being prevented from providing said visual indication of said predetermined legend when said light valve is in said first state, and operator means containing said indicator means for initiating a control function related to said predetermined legend.

2. An indicator and operator assembly as defined in claim 1 further including a low intensity light source for illuminating said predetermined legend on said indicator, said light source being responsive to said means for energizing and de-energizing said light valve for simultaneously energizing said light source and said light valve and simultaneously de-energizing said light source and said light valve, said light valve and said light source when energized providing for a visual indication of said predetermined legend and when de-energized preventing a visual indication of said predetermined legend.

3. An indicator and operator assembly as defined in claim 2 further including filter means disposed between said low intensity light source and said indicator for passing only predetermined wavelengths of light from said light source to said indicator.

4. An indicator and operator assembly as defined in claim 3 wherein said predetermined wavelengths of light which pass through said indicator are night vision goggle compatible.

5. An indicator and operator assembly as defined in claim 2 wherein said indicator includes a first portion which is substantially opaque and a second portion which is translucent, said second portion defining said predetermined legend and wherein said light source and light valve when simultaneously energized provide for the passage of light from said light source through said translucent portion of said indicator and through said light valve to provide said visual indication of said predetermined legend.

6. An indicator and operator assembly as defined in claim 5 wherein said first portion of said indicator which is substantially opaque is substantially non-reflective of ambient light and said second portion of said indicator which is translucent is reflective of ambient light.

7. An indicator and operator assembly as defined in claim 6 wherein ambient light reflected from said translucent second portion of said indicator is operable to provide a visual indication of said predetermined legend when said light valve is in said substantially transparent second state.

8. An indicator and operator assembly as defined in claim 6 wherein said second translucent portion of said indicator is operable to provide a visual indication of said predetermined legend when said light source is energized and said light valve is in said first substantially opaque state.

9. An indicator assembly readable in ambient light and no-ambient light conditions comprising:

a legend plate having a viewing surface disposed toward ambient light and reflective thereof, said legend plate comprising translucent legend elements disposed in complementary openings in a background substrate, said openings extending through said substrate from said viewing surface to a surface at an opposite side of said legend plate;

a low intensity light source disposed at said opposite side of said legend plate;

filter means disposed adjacent said surface at said opposite side for blocking transmission of unwanted wavelengths through said translucent legend elements;

a light valve covering said viewing surface of said legend plate, said light valve being operable in response to an electric signal for changing transmissivity thereof between substantially transparent and substantially opaque states; and means electrically connecting said light source and said light valve for energization of said light source coincidentally with operation of said light valve to said substantially transparent state.

10. The indicator assembly defined in claim 9 wherein said elements of said legend comprise a first level of reflectivity at said viewing surface and said background substrate comprises a second level of reflectivity at said viewing surface different from said first level.

11. The indicator assembly defined in claim 10 wherein one of said first and second levels of reflectivity is substantially non-reflective.

12. The indicator assembly defined in claim 11 wherein one of said background substrate and said legend elements is more transmissive of light than the other of said background substrate and legend elements for providing a contrast between said background substrate and said legend elements.

13. The indicator assembly defined in claim 12 wherein one of said background substrate and said legend elements transmits a first wavelength of light energy and an other thereof transmits a second wavelength of light energy for providing a contrast between said background substrate and said legend elements.

14. The indicator assembly defined in claim 13 wherein one of said substrate and said legend elements is substantially opaque.

15. The indicator assembly defined in claim 14 wherein said substantially opaque one of said substrate and said legend elements comprises said substantially non-reflective level of reflectivity at said viewing surfaces.

16. A sunlight readable indicator assembly operable to indicating and non-indicating states comprising:

a legend plate having a viewing surface reflective of ambient light; and a light valve juxtaposed said viewing surface operable in response to an electric signal for changing transmissivity thereof between substantially opaque and substantially transparent states, said light valve being substantially opaque in a non-indicating state of said indicator assembly, blocking ambient light from said legend plate.

17. The sunlight readable indicator assembly defined in claim 16 wherein said legend plate comprises a background substrate providing a legend at said viewing surface, elements of said legend comprising a first level of reflectivity at said viewing surface and said background substrate comprises a second level of reflectivity at said viewing surface different from said first level.

18. The sunlight readable indicator assembly defined in claim 17 wherein one of said first and second levels of reflectivity is substantially non-reflective.

19. The sunlight readable indicator assembly defined in claim 18 wherein said indicator assembly is operable to an indicating state during a diminished ambient light condition, said indicator assembly comprising a light source disposed at a side of said legend plate opposite said viewing surface, at least one of said legend elements and said background substrate being translucent.

20. The sunlight readable indicator assembly defined in claim 19 wherein one of said background substrate and said legend elements is more transmissive of light than the other of said background substrate and legend elements for providing a contrast between said background substrate and said legend elements.

21. The sunlight readable indicator assembly defined in claim 20 wherein one of said background substrate and said legend elements transmits a first wavelength of light energy and an other of said background substrate and said legend elements transmits a second wavelength of light energy for providing a contrast between said background substrate and said legend elements.

22. The sunlight readable indicator assembly defined in claim 19 wherein one of said substrate and said legend elements is substantially opaque.

23. The sunlight readable indicator assembly defined in claim 22 wherein said substantially opaque one of said substrate and said legend elements comprises said substantially non-reflective level of reflectivity at said viewing surfaces.

24. The sunlight readable indicator light assembly defined in claim 19 wherein said light source is connected for energization coincidentally with operation of said light valve to said substantially transparent state.

25. The sunlight readable indicator light assembly defined in claim 24 wherein said light valve is electrically energized for operation thereof to said substantially transparent state.

26. The sunlight readable indicator assembly defined in claim 25 wherein said light source is a low intensity light source.

27. The sunlight readable indicator assembly defined in claim 26 wherein said low intensity light source emits light in a narrow bandwidth.

28. The sunlight readable indicator assembly defined in claim 27 wherein filter means for filtering unwanted wavelengths emitted by said light source is disposed between said legend plate and said light source.

29. The sunlight readable indicator assembly defined in claim 28 wherein said light emitted by said light source and transmitted through said translucent one of said background substrate and said legend elements is night vision goggle compatible.

30. The sunlight readable indicator assembly defined in claim 1 wherein said light valve, said legend plate and said filter means each comprise discrete members of said indicator assembly retained together in an unbonded stacked assembly.

* * * * *